US008459938B2

(12) United States Patent
Fäth et al.

(10) Patent No.: US 8,459,938 B2
(45) Date of Patent: Jun. 11, 2013

(54) ADJUSTING RING FOR ADJUSTING THE BLADES OF THE VTG DISTRIBUTOR OF EXHAUST GAS TURBOCHARGERS

(75) Inventors: Holger Fäth, Fussgönhelm (DE); Ralf Böning, Reiffelbach (DE); Dirk Frankenstein, Worms (DE)

(73) Assignee: BorgWarner Inc., Auburn Hills, MI (US)

( * ) Notice: Subject to any disclaimer, the term of this patent is extended or adjusted under 35 U.S.C. 154(b) by 733 days.

(21) Appl. No.: 11/913,896

(22) PCT Filed: Mar. 10, 2006

(86) PCT No.: PCT/EP2006/002233

§ 371 (c)(1),
(2), (4) Date: Nov. 25, 2008

(87) PCT Pub. No.: WO2006/122596

PCT Pub. Date: Nov. 23, 2006

(65) Prior Publication Data

US 2009/0142185 A1 Jun. 4, 2009

(30) Foreign Application Priority Data

May 13, 2005 (EP) ..... 05010523

(51) Int. Cl.
*F01D 17/16* (2006.01)

(52) U.S. Cl.
USPC ..... 415/159; 29/889.2; 228/110.1; 228/111.5

(58) Field of Classification Search
USPC ..... 29/889, 889.2, 889.22; 228/110.1, 228/111.5; 415/159–166
See application file for complete search history.

(56) References Cited

U.S. PATENT DOCUMENTS 4,373,859 A * 2/1983 Thebert ..... 415/159
4,438,989 A * 3/1984 Negele et al. ..... 384/477
4,654,941 A * 4/1987 Burdette et al. ..... 29/889.22
4,702,672 A * 10/1987 Leicht et al. ..... 415/164
4,720,240 A * 1/1988 Bronowski et al. ..... 415/163

(Continued)

FOREIGN PATENT DOCUMENTS

EP 1234950 * 2/2001
EP 1234950 8/2002

(Continued)

OTHER PUBLICATIONS

Written Opinion of the International Searching Authority, App. No. PCT/EP2006/002233, all pages.*

(Continued)

*Primary Examiner* — Fernando L Toledo
*Assistant Examiner* — Victoria K Hall
(74) *Attorney, Agent, or Firm* — William G. Anderson; Stephan A. Pendorf; Patent Central LLC

(57) ABSTRACT

The invention relates to an adjusting ring (1) for adjusting the blades of the VTG distributor of exhaust gas turbochargers, comprising a bearing ring (2) and a lever engagement ring (3) connected to said bearing ring (2), the bearing ring (2) and lever engagement ring (3) being separately manufactured individual parts which are connected to each other by means of a separate connection means (4).

19 Claims, 1 Drawing Sheet

U.S. PATENT DOCUMENTS

| | | | | |
|---|---|---|---|---|
| 4,770,603 | A | 9/1988 | Engels et al. | |
| 6,471,470 | B2 * | 10/2002 | Yoshimura et al. | 415/160 |
| 6,710,021 | B1 * | 3/2004 | Fisher | 508/152 |
| 6,916,153 | B2 | 7/2005 | Boening | |
| 6,925,806 | B1 * | 8/2005 | Zollinger et al. | 60/602 |
| 6,984,104 | B2 * | 1/2006 | Alexander et al. | 415/159 |
| 7,281,892 | B2 * | 10/2007 | Lejars et al. | 415/160 |
| 7,396,203 | B2 * | 7/2008 | Martindale | 415/136 |
| 2002/0015543 | A1 * | 2/2002 | Pairone et al. | 384/477 |
| 2004/0081567 | A1 * | 4/2004 | Boening | 417/406 |

FOREIGN PATENT DOCUMENTS

| | | | |
|---|---|---|---|
| EP | 1398463 | | 3/2004 |
| EP | 1422385 | | 5/2004 |
| JP | 2001-173681 | * | 6/2001 |
| WO | WO2004/035991 | * | 4/2004 |

OTHER PUBLICATIONS

Written Opinion of the International Searching Authority, App. No. PCT/EP2006/002233 (Mar. 12, 2007), all pages.*

* cited by examiner

ADJUSTING RING FOR ADJUSTING THE BLADES OF THE VTG DISTRIBUTOR OF EXHAUST GAS TURBOCHARGERS

CROSS-REFERENCE TO RELATED APPLICATIONS

This application is a §371 national stage entry of International Application No. PCT/EP2006/002233, filed Mar. 10, 2006, which claims priority to EP Application No. 05010523.8, filed May 13, 2005, both of which are hereby incorporated by reference.

The invention relates to an adjusting ring for adjusting the blades of the VTG distributor of exhaust gas turbochargers.

The term "VTG distributor" is to be understood to mean an arrangement which serves to provide exhaust gas turbochargers with a variable turbine geometry. An adjusting ring of the type specified in the preamble of claim 1 serves to adjust said variable turbine geometry, which adjusting ring has a bearing ring for holding bearing bodies and a lever engagement ring. The lever engagement ring is provided with grooves into which the levers of the VTG blades engage.

Such known adjusting rings are formed as fully-cut components which are conventionally produced in turning or milling processes or combined working steps. For this purpose, the adjusting ring with its bearing ring and a lever engagement ring is formed as an integral part from a solid material. This is however a relatively time-consuming and expensive production method.

Casting a complete adjusting ring raw part with subsequent cutting machining also does not lead to significant cost advantages.

It is therefore an object of the present invention to create an adjusting ring of the type specified in the preamble of claim 1, which adjusting ring can be produced in a simple and cost-effective manner.

It is also an object of the invention to create a method for producing an adjusting ring of said type.

The achievement of said object is provided by means of the claimed features.

According to the invention, the adjusting ring is produced from a plurality of separately produced individual parts, at least two separately produced individual parts, which are connected to one another by means of a suitable connecting means. Here, the individual parts can be produced completely by primary forming (fine casting or sintering), shaping (pressing) or separating methods, preferably punching, or require a small degree of cutting finishing such as turning or milling.

The individual parts can be composed of different materials which are adapted to the specific bearing function of the bearing ring or bearing section of the adjusting ring, and to the guidance of the blade levers of the lever engagement ring or lever engagement section.

There is also the advantage that the bearing ring and the lever engagement ring can be adapted to said functions in a simple manner in terms of their geometry. Targeted hardening of the surface according to the required properties is for example possible.

The dependent contain advantageous refinements of the adjusting ring according to the invention.

The claims further define a method according to the invention for producing an adjusting ring as explained above.

According to said claims, the bearing ring and the lever engagement ring are produced in each case in a separate production step as separate individual parts.

The two rings are thereafter connected to one another by means of a suitable connecting means.

In principle, all suitable cohesive or form-fitting connections can be considered as a connecting means.

In the method according to the invention, however, flanging or overturning processes and also welding or soldering are particularly preferred for connecting the bearing ring and the production ring.

In principle, a screw connection or a rivet connection would also be conceivable.

Further details, advantages and features of the invention can be gathered from the following description of an exemplary embodiment on the basis of the drawing, in which:

FIG. 1 illustrates an adjusting ring 1 according to the invention for adjusting the blades of a VTG distributor of exhaust gas turbochargers.

The adjusting ring 1 has a bearing ring 2 which is provided for guiding suitable bearing bodies (rolling bodies).

In addition, the adjusting ring 1 has a lever engagement ring 3 which has a plurality of grooves arranged on the periphery, one of which grooves is denoted by the reference symbol 5.

Figure 1:
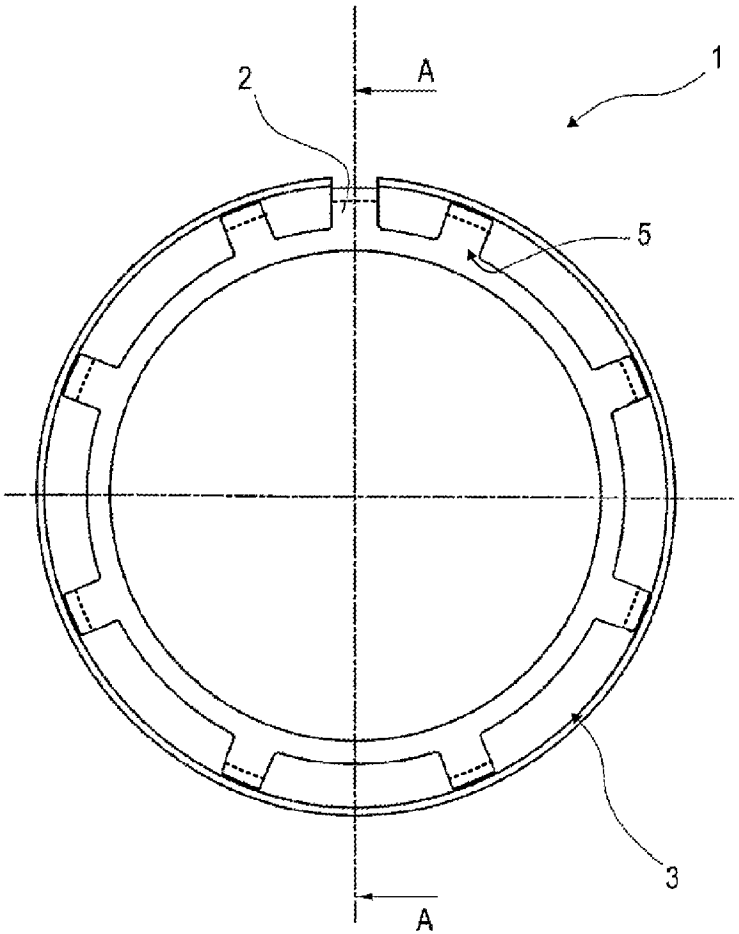
FIG. 1 shows a front view of an adjusting ring according to the invention.
Figure 2:
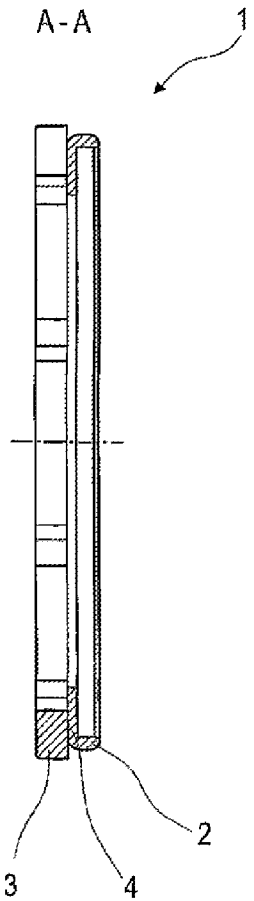
FIG. 2 shows a section illustration of the adjusting ring as per FIG. 1 along the line A-A in FIG. 1.

As shown in FIG. 1, the adjusting ring with its two components, the bearing ring and the lever engagement ring 3, is a circular component which is illustrated again in FIG. 2 along the section line A-A.

Here, FIG. 2 shows that the bearing ring 2 and the lever engagement ring 3, after their production as individual parts, are connected to one another by means of a connecting means 4 in order to form the adjusting ring 1 in its entirety. The connecting means 4 is shown here by the separating line between the bearing ring 2 and the lever engagement ring 3 and can be generated by means of one of the production methods explained in the introduction.

LIST OF REFERENCE SYMBOLS

1 Adjusting ring
2 Bearing ring
3 Lever engagement ring
4 Connecting means
5 Groove

The invention claimed is:

1. A method for producing an adjusting ring for adjusting the blades of the VTG distributor of exhaust gas turbochargers, the method comprising:

producing a bearing ring as a separate component, the bearing ring being generally disc-shaped and having a central opening;

producing a lever engagement ring as a separate component in a separate production step from the producing of the bearing ring, the lever engagement ring being generally disc-shaped and having a central opening, a plurality of grooves being provided in the lever engagement ring, the plurality of grooves being distributed circumferentially about and opening to the central opening of the lever engagement ring, the grooves being configured to receive a portion of a lever therein; and connecting the bearing ring fixed against rotation to the lever engagement ring by a connecting means such that the bearing ring is substantially adjacent to the lever engagement ring, whereby no structures are disposed therebetween other than at most the connecting means.

2. The method as claimed in claim 1, further comprising punching separate sheet metal parts to form at least in part at least one of the bearing ring and the lever engagement ring.

3. The method as claimed in claim 1, further comprising sintering separate sheet metal parts to form at least in part at least one of the bearing ring and the lever engagement ring.

4. The method as claimed in claim 1, wherein the connecting means includes welding or soldering.

5. The method as claimed in claim 1, wherein the bearing ring and the lever engagement ring are the same materials.

6. The method as claimed in claim 1, further comprising providing at least one of the bearing ring and the lever engagement ring with a geometry that provides a bearing function or a guidance function for the adjusting ring.

7. The method as claimed in claim 1, further comprising providing the bearing ring as a sheet metal part.

8. The method as claimed in claim 1, further comprising providing the lever engagement ring as a sheet metal part.

9. The method as claimed in claim 1, further comprising punching separate sheet metal parts to form at least in part both the bearing ring and the lever engagement ring.

10. The method as claimed in claim 1, further comprising sintering separate sheet metal parts to form at least in part both the bearing ring and the lever engagement ring.

11. An adjusting ring for adjusting the blades of the VTG distributor of exhaust gas turbochargers, the adjusting ring comprising:

a bearing ring, the bearing ring being generally disc-shaped and having a central opening;

a lever engagement ring connected to the bearing ring, the lever engagement ring being generally disc-shaped and having a central opening, a plurality of grooves being provided in the lever engagement ring, the plurality of grooves being distributed circumferentially about and opening to the central opening of the lever engagement ring, the grooves being configured to receive a portion of a lever therein; and a connecting means, wherein the bearing ring and the lever engagement ring are individual parts which are connected to one another fixed against rotation by the connecting means such that the bearing ring is substantially adjacent to the lever engagement ring, whereby no structures are disposed therebetween other than at most the connecting means.

12. The adjusting ring as claimed in claim 11, wherein at least one of the bearing ring and the lever engagement ring has a geometry that provides a bearing function or a guidance function for the adjusting ring.

13. The adjusting ring as claimed in claim 11, wherein the bearing ring and the lever engagement ring are the same materials.

14. The adjusting ring as claimed in claim 11, wherein the connecting means is formed as a flanged connection.

15. The adjusting ring as claimed in claim 11, wherein the connecting means includes welding or soldering.

16. A method for producing an adjusting ring for adjusting the blades of the VTG distributor of exhaust gas turbochargers, the method comprising:

punching a first sheet metal part to form at least in part a bearing ring, the bearing ring being generally disc-shaped and having a central opening;

punching a second sheet metal part to form at least in part a lever engagement ring, the lever engagement ring being generally disc-shaped and having a central opening, a plurality of grooves being provided in the lever engagement ring, the plurality of grooves being distributed circumferentially about and opening to the central opening of the lever engagement ring, the grooves being configured to receive a portion of a lever therein; and connecting the bearing ring to the lever engagement ring fixed against rotation using a connecting means such that the bearing ring is substantially adjacent to the lever engagement ring, whereby no structures are disposed therebetween other than at most the connecting means.

17. The method as claimed in claim 16, wherein the bearing ring and the lever engagement ring are the same materials.

18. The method as claimed in claim 16, wherein the connecting means is formed as a flanged connection.

19. The method as claimed in claim 16, wherein the connecting means includes welding or soldering.

* * * * *